US005349511A

United States Patent [19]

Henderson

[11] Patent Number: 5,349,511

[45] Date of Patent: Sep. 20, 1994

[54] WORK LAMP, WITH HOLDER THEREFOR

[76] Inventor: John Henderson, 7406 Forest Preserve Dr., Chicago, Ill. 60634

[21] Appl. No.: 17,146

[22] Filed: Feb. 12, 1993

[51] Int. Cl.[5] ..... F21V 21/00

[52] U.S. Cl. ..... 362/396; 362/398

[58] Field of Search ..... 362/190, 191, 396, 398, 362/399, 391

[56] References Cited

U.S. PATENT DOCUMENTS

| | | | |
|---|---|---|---|
| 4,376,965 | 3/1983 | Bacevius | 362/396 X |
| 4,676,465 | 6/1987 | Myotte | 362/396 X |
| 4,985,817 | 1/1991 | Yale | 362/396 |

*Primary Examiner*—Stephen F. Husar
*Attorney, Agent, or Firm*—Walter C. Ramm

[57] ABSTRACT

A work lamp of type known as trouble lamps or drop lights, with components including a handle defining an axis for the lamp and opposed first and second ends, a socket for a light source in the second end, a cage for the light source attached to the handle, a hook, and a power connection for the light source, and with an improvement which is a member or element comprising a shank on and extending away from the handle near the first end and at a right or obtuse angle to the axis. As to holding means with a channel or hole, the shank implements the lamp to be received and adjustably retained in a channel or hole of such means in a wide range of dispositions and other than an enabled by the hook. The shank may be embodied as a demountable fitting for the handle. Holding means with a channel or hole, including a holder with a magnetic base and a channeled slab wherein the shank may be received, are disclosed.

6 Claims, 3 Drawing Sheets

Fig. 7
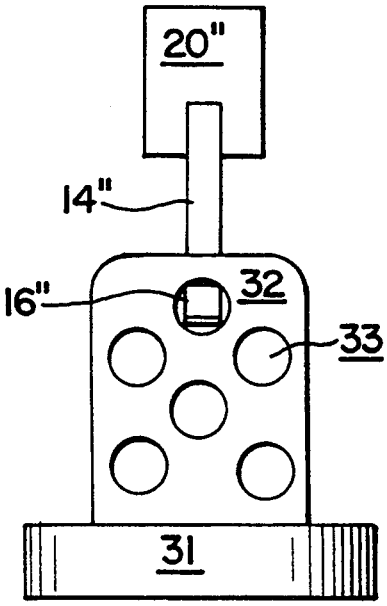
Fig. 8
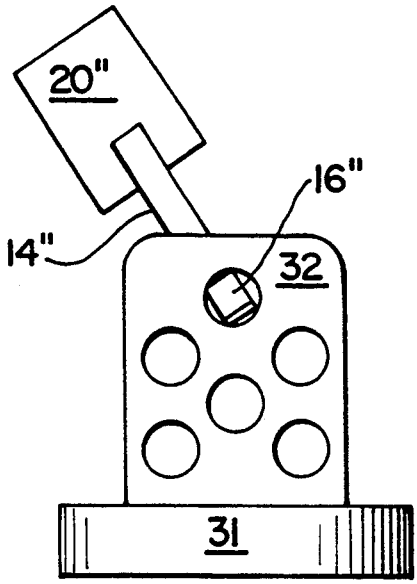
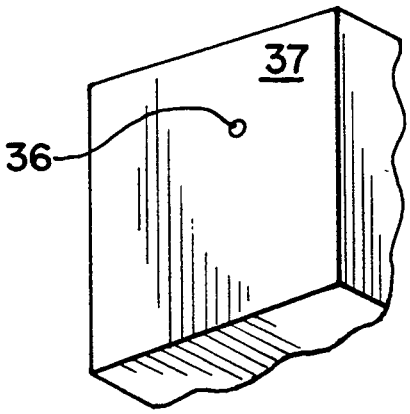
Fig. 9

WORK LAMP, WITH HOLDER THEREFOR

BACKGROUND OF THE INVENTION

1. Field of the Invention

This invention is in the field of illumination and relates particularly to improved work lamps implemented for a wide range of in-service illuminative dispositions.

2. Description of Related Art

The art related to this invention includes the disclosures of these United States Letters Patent:

U.S. Pat. No. 1,932,143, Permanent Magnet Support For Lamps, discloses a bolt and wing nut assembly for clamping a portable lamp and magnetic holder at suitable angles to each other.

U.S. Pat. No. 2,506,400, Magnetic Support, discloses a magnetic support to which the cage of a portable lamp is clipped and thereby held.

U.S. Pat. No. No. 2,747,079, Trouble Light And Suspension Means, discloses a lamp suspended from, in addition to its hook, a swivel element.

U.S. Pat. No. No. 4,019,047, Trouble Lamp For Mechanics, discloses a trouble lamp with a magnetic holder and arranged for axial rotation relative to the holder.

U.S. Pat. No. No. 4,727,462, Clamp-On Magnet For Trouble Lamps, discloses a magnetic holder with two parallel spring clamps for a trouble lamp.

SUMMARY OF THE INVENTION

Portable lamps of the type known as trouble lamps or drop lights are familiar, especially to mechanics, repair people and others whose work requires temporary close-at-hand illumination in work places where, for their purposes, other lighting may be less than optimal. Lamps of the type may utilize an incandescent bulb or some other light source. In this summary and specification such a lamp is called a "work lamp", and the light source is exemplified as a "bulb".

Generically, a work lamp has characteristic components including a handle with opposed first and second ends, a socket in the second end, a bulb in the socket, a cage for the bulb attached to the handle and including a shield, a hook on the cage and opposite the socket, and a power connection or source, with an on-off switch, for the bulb. The cage may be metallic wire (as, formerly, was often the case) or embodied to include plastic or other material (as is now often seen). The handle defines a lengthwise axis of the lamp. The hook adapts the lamp to be associated with a feature such as a bar, hook, edge, bend, or means defining a hole or channel, by being "dropped" or suspended from the feature.

Handles of or for some work lamps are, as to other components of the lamps, optionally joinable, separable and/or interchangeable elements, and are familiar as discrete articles of commerce.

This invention relates to improved work lamps or improved work-lamp handles. Specifically, the improvement is a shank as a structural element on or for the handle. The shank adapts the lamp to be held in holding means with a channel or hole as might be found near a work space or as otherwise as to be described. In this specification said holding means with a channel or a hole are called "channel means". With the shank in channel means, the lamp may be utilized other than in suspended disposition, and adjusted to and retained in a selected one of several possible dispositions.

This invention provides an optional holder for the improved work lamp in case other channel means are not at hand. The holder has a base adapted for supportive placement and a slab on the base. The slab defines several holes or channels. The channels may be tubular or of other conformation. As the holder is support/rely placed on a suitable surface, the slab extends from the surface, and the shank may be inserted in one of the channels and, as inserted and in cooperation with the slab, carry and adjustably retain the lamp.

One object of this invention is to implement a work lamp for in-service dispositions and orientations other than as may be enabled by the lamp's hook, thereby expanding and enhancing its capabilities.

Another object of this invention is a work lamp adapted by a shank, as well as by the hook of the prior art, for a wide range of dispositions and orientations, and, within the range, for ready adjustment to and reliable retention in selected orientations that are—in keeping with the course of the work and changing illumination needs therefor—effectively optimal.

A still further object of this invention is a portable and channeled holder for the improved work lamp in work areas where other channel means for the lamp are not available or apparent.

BRIEF DESCRIPTION OF THE DRAWINGS

In the drawings:

FIG. 7 is a rear elevation view of the holder of FIG. 4 with an exemplary shank element—representative of both the shank member of FIG. 1 and the permanent shank of FIG. 6—in a channel of the holder. The shank element carries a schematic lamp representative of both the lamp of FIG. 2 and the lamp in FIG. 6, and the shank and lamp are at a first position as to the holder.

FIG. 8 is the same rear view as FIG. 7, but with the exemplary shank element and schematic lamp at a second or adjusted position as to the holder.

FIG. 9 is a sketch of a wall with a hole therein.

DETAILED DESCRIPTIONS OF PREFERRED EMBODIMENTS

The drawings illustrate preferred embodiments of this invention—a first embodiment and a second embodiment—as well as channel means for and dispositions of work lamps of the first and second embodiments in such means.

First Embodiment

Figure 1:
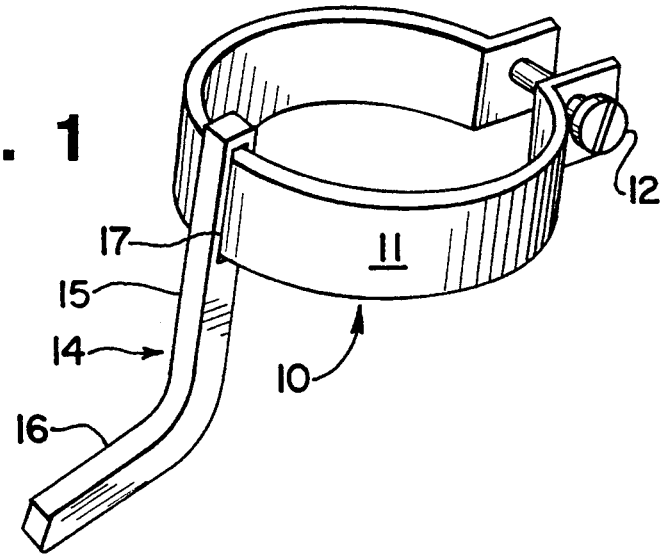
FIG. 1 is a perspective view of a clamp and shank member comprising a optionally demountable fitting for a work lamp.
Figure 2:
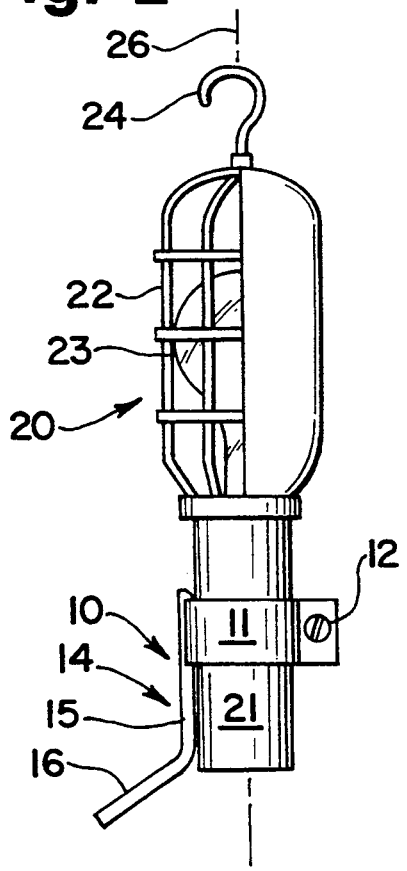
FIG. 2 is an elevation view of a first work lamp with the fitting of FIG. 1 on the tamp.

The first embodiment, shown in FIGS. 1–2, is demountable fitting 10, comprising clamp 11 and shank member 14, for work lamp 20. Referring to FIG. 1, the clamp has a circumferential strap arranged to be tensioned and released by screw 12, and threaded portions for the screw. The shank, which is to be rigidly joined with the lamp, has first portion 15 and second portion 16, and defines slot 17 in the first portion. The strap is received in the slot and thereby functionally connected with the shank. The clamp and the slot are matched; that is, the length of the slot exceeds only slightly the width of the strap, and the width of the slot exceeds only slightly the thickness of the strap. The first and second portions of the shank are generally straight and shaped or bent to form, relative to each other, an angle of not less than 90° and not more than 179°. The distal portion defines a maximum trans-portion dimension and may advantageously have rectangular cross section. For a rectangular cross-section the maximum trans-portion dimension is the diagonal between opposite corners thereof.

Clamp 11 may be a #14 hose clamp, and shank 14 may be a square steel rod 4 inches in length and with a side dimension of ¼ inch, conventionally slotted near the end of portion 15, and bent so portions 15 and 16 form an angle of at least 90°, less than 180° and, preferably and as shown, approximately 140°.

Referring to FIG. 2, fitting 10 is mounted on conventional lamp 20. Handle 21 has opposed first and second ends, with the socket for the bulb at the second end, and defines lengthwise axis 26 of the lamp. Bulb 23 is in the socket, cage 22 is around the bulb, hook 24 is on the cage, and power cord 25 extends from the first end. With clamp 11 in slot 17, the fitting was passed around the first end, and screw 12 tightened thus closing and tensioning the clamp so that, as shown, the clamp rigidly grips and the fitting is firmly attached to the handle. Portion 15 is proximal of the clamp, proximate the handle, and parallel to the axis. Portion 16 is distal of the clamp and extends outwardly from the handle proximate the first end, at said angle relative to the axis, and away from the cord.

Fitting 10 implements lamp 20 to be adjustably carried in channel means and, as hereinafter described, for in-service dispositions in such means and other than as enabled by hook 24.

Fitting 10 is optionally demountable and, when not needed, is removed from lamp 20 by loosening screw 12 and de-tensioning and releasing clamp 11 from handle 21, and may easily be kept in a tool kit or bin.

Second Embodiment

Figure 3:
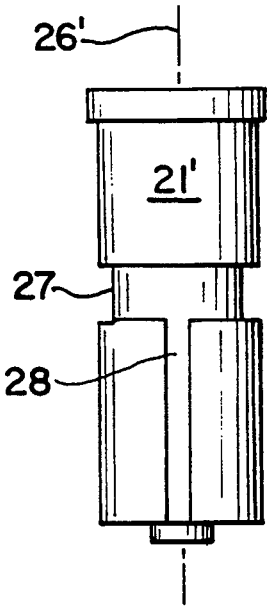
FIG. 3 is an elevation view of a handle of the type which is optionally joinable with other work lamp components. The handle is adapted for, but has not received, a permanent shank member.
Figure 6:
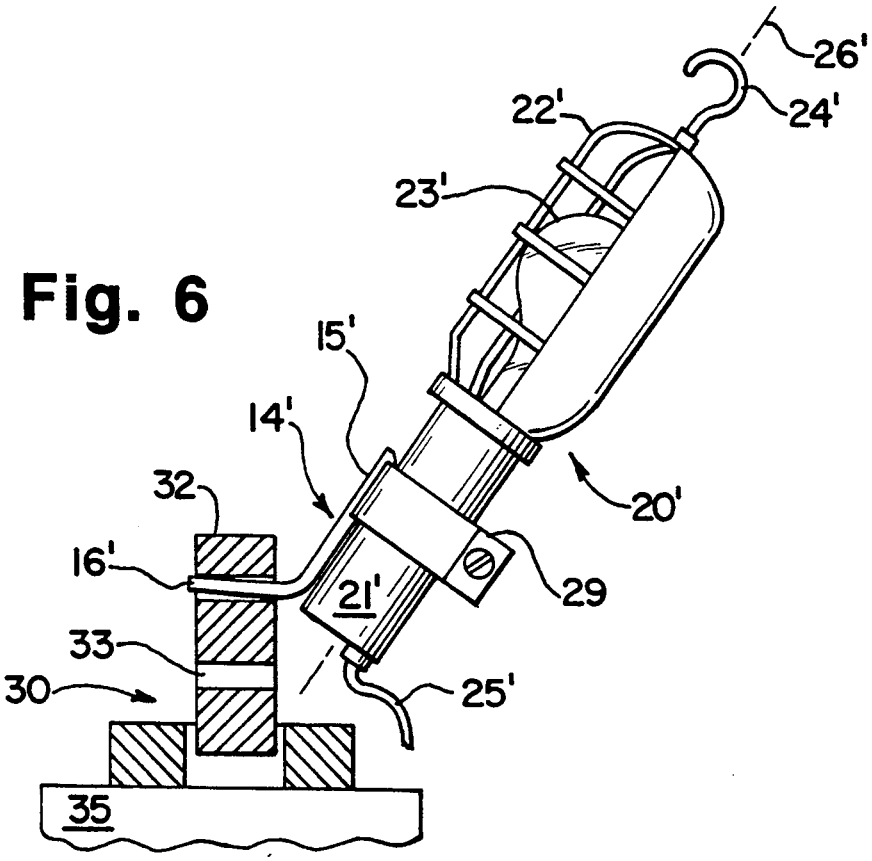
FIG. 6 includes a sectional view of the holder of FIG. 4, taken along line 6—6 of FIG. 5, and side elevation view of a second work lamp including the handle of FIG. 3 as joined with other work lamp components. A permanent shank is carried on the handle. One portion of the shank is in a lengthwise groove in the handle, and another portion of the shank is in a channel of the holder.

FIGS. 3 and 6 relate to the second embodiment. The second embodiment resembles the first embodiment in certain respects, and in this description of the second embodiment, reference numerals include— for elements that are similar to or correspond with elements of the first embodiment—primes of the numerals of the first embodiment.

Referring to FIG. 3, handle 21' is of a type optionally joinable with and separable from other lamp components, and defines groove 27 and groove 28 as surface features as well as axis 26' and first and second ends. Groove 27 is circumferential of the handle and intermediate the ends, and may be wide and of torroidal contour. Groove 28 is parallel to axis 26' and relatively narrow, and runs from groove 27 toward the first end. Handle 21', for example, may comprise or be coated with plastic or similar material wherein grooves 27 and 28 are molded, machined or otherwise conventionally formed.

Referring to FIG. 6, the second embodiment is shown as handle 21' with collar 29 and shank 14' on the handle, and as joined with other components including cage 22', bulb 23', hook 24' and cord 25', to comprise lamp 20'. The collar—basically, a permanent ring or clamp—conforms with and is permanently and tightly seated in groove 27. Shank 14' includes proximal portion 15' and distal portion 16', is permanently and rigidly attached to the collar, and extends from the collar with portion 15' in groove 28. Portion 15' is parallel to axis 26'. Portion 16'—as the case may be, of about the same shape and size as portion 16 or somewhat shorter than portion 15'—forms an obtuse angle with portion 15' and, proximate the first end of handle 21, extends away from the handle and cord 25'.

The seating of collar 29 in groove 27 is conventional. The collar may comprise several pieces which have been separately placed in groove 27 and then joined in situ. The collar and handle 21' may frictionally engage or be otherwise adapted against relative movement. The collar and shank 14' may be metallic and joined together by welding or other conventional means, and portion 15' in groove 28 may be affixed to the handle by adhesive or other means further to prevent unwanted movement between the collar and handle.

Portion 16' implements lamp 20' to be adjustably carried in channel means and, as hereinafter described, for in-service dispositions in such means and other than as enabled by hook 24.

In-Service Dispositions and Channeled Holding Means

This description of in-service dispositions and channel means applies in respect of both the first and second embodiments. FIGS. 4–8 variously illustrate holder 30 as exemplary channel means for a work lamp with fitting 10 or shank 14'.

Figure 4:
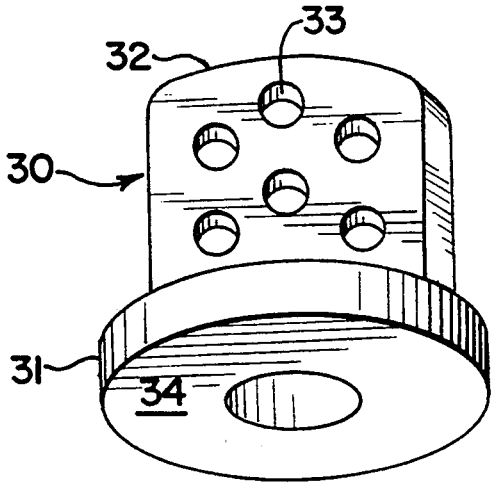
FIG. 4 is an upward perspective view of a holder for the work lamp of this invention.
Figure 5:
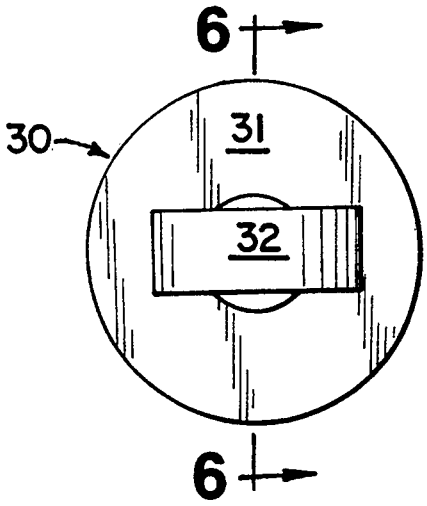
FIG. 5 is a plan view of the holder of FIG. 4.

Referring to FIGS. 4–5, holder 30 includes base 31 and slab 32 on and extending from the base. Typically, the base, as in FIG. 4, has tabular surface 34. The slab defines a plurality of channels 33 and, as shown, may be normal to the tabular surface.

More specifically, base 31 is magnetic and has torroidal shape, and slab 32 may be carried in notches on the interior wall of the base. The slab and base are permanently joined for example, they may be cemented together. The base may have a plastic encasement or be of elastomeric magnetic material, and is adapted magnetically to be attached or clamped, in a position of supportive placement, to a substantially planar ferromagnetic or similar surface with surface 34 in contact with the planar surface.

Each channel 33 is adapted to receive a corresponding distal portion of a shank, such as portion 16 or 16', and defines a cross-section slightly larger than the maximum trans-portion dimension of that distal portion. Preferably, as shown, the channels are circular. For a square distal portion with a nominal side dimension of ¼-inch, a suitable channel diameter may be as small as ⅜-inch.

Referring again to FIG. 6, feature 35 defines a planar surface, holder 30 is in a position of supportive placement on said planar surface, and portion 16' is inserted and held in a channel 33 of the holder. Lamp 20' is at a first position or orientation in accordance with this invention. With the maximum trans-portion dimension slightly less than the diameter of the channel, the lamp imposes a moment and nominal downward tilt upon portion 16'. This moment enforces or enhances contact between portion 16' and the wall of channel 33, and thereby serves or contributes, frictionally, to steady and adjustably to retain the lamp.

Notice may be taken that in supportive placement channel means such as holder 30 should be suitably secure to sustain the imposed moment. For example, base 31 should be characterized by sufficient size or magnetic force so that it may not tip or displace on account of the load imposed by the lamp.

In FIGS. 7–8, shank 14'' is representative of shanks 14 and 14'', schematic lamp 20'' is representative of lamps 20 and 20'', and distal portion 16'' of shank 14'' has uniform rectangular cross-section and thereby defines the maximum trans-portion dimension thereof.

FIG. 7 generally corresponds with FIG. 6. Holder 30 is in supportive placement. Portion 16'' is in a channel 33 of the holder. Lamp 20'' is at the same relative first position as lamp 20'.

FIG. 8 shows lamp 20'' angularly adjusted to and in a second position or orientation. Adjustment from the first position to the second position is made by these hand operations: lifting the lamp by the small degree necessary to relieve the moment and for portion 16'' and the axis of channel 33 to become aligned, turning the lamp—with the clearance of the dimensional differences and portion 16'' in channel 33—to the angle of the second position, and releasing the lamp so that the moment is reimposed on portion 16'. Such an adjustment is, for example, appropriate to change illumination from the lamp to meet changing needs in the course of a work project.

Lamp 20'' may be changed from a one to another position in other ways. For example, by withdrawing and shifting portion 16'' from one to another of the channels 33, or by relocating holder 30. And convenient channel means for a work lamp in the "drop" mode may be had by attaching holder 30 to supportive position on a vertical wall or overhead surface, with slab 32 outwardly or downwardly disposed, and so that a hook such as hook 25 may be placed in a channel 33.

Accordingly, these described embodiments implement a work lamp for a wide range of in-service dispositions and orientations and, within the range, for an easy adjustment or sequence of adjustments to, and reliable retention in a selected position or series of positions whereof each—for the immediate purpose—is effectively optimal.

Channel means other than holder 30 may be availed of for purposes of this invention. The sketch of FIG. 9 indicates that an available, suitably sized hole 36 in wall 37, or a similar or equivalent fixture or means, may serve. A non-magnetic holder similar to slab 32 may be provided as a permanent fixture at or near a work place.

In addition to the described embodiments, and as enabled by the disclosures of this specification, modifications, variations and other versions of an improved work lamp are within the spirit and scope of this invention.

What is claimed is:

1. For a work lamp of the type which has a handle defining an axis, generally opposed first and second ends, and a socket for a light source at the second end, and which is adapted to be associated with holding means with a channel, the improvement comprising a shank member which is rigidly joined with the work lamp, extends from the handle proximate the first end, forms an angle relative to the axis, and is adapted to be received in a channel of and adjustably retained by the holding means.

2. The improvement of claim 1 where the shank member comprises an optionally demountable fitting for the handle and, when mounted on the work lamp, forms an obtuse angle relative to the axis.

3. A handle for work lamp of the type wherefor said handle, when and as joined with the lamp, defines an axis, generally opposed first and second ends of the handle, and a socket for a light source at the second end, said handle comprising a shank element which extends from proximate the first end thereof and is at an obtuse angle relative to the axis.

4. Apparatus for a work lamp of the type which comprises a handle defining an axis, first and second ends, and a socket for a light source in the second end, the apparatus comprising a holder with a base adapted to be placed in a position of supportive placement and a slab extending from the base and defining at least one channel and a clamp adapted rigidly to grip the handle and a shank with a proximal portion joined with the clamp and a distal portion extending from and forming an angle with the proximal portion, whereof, when the clamp rigidly grips the handle, the proximal portion is generally parallel with and proximate the handle, and the distal portion extends outwardly of the handle from proximate the first end, and is adapted to be received and adjustably retained in a channel when the base is in a position of supportive placement.

5. The apparatus of claim 4 where the clamp and shank comprise an optionally demountable fitting for the lamp, with tensioning and release means for the clamp, and where, when the clamp grips the handle, the distal portion forms substantially the obtuse angle with the axis.

6. The apparatus of claim 4 where the base comprises elastomeric magnetic material to adapt the base to be in a position of supportive placement and defines a tabular surface; the slab is normal to and extends away from the tabular surface, and defines a plurality of channels; each channel is circular and has an equal diameter; and, the distal portion forms an obtuse angle relative to the proximal portion and has a rectangular cross-section whereof the maximum trans-portion dimension is slightly less than the diameter of a channel.

* * * * *